US008666281B2

(12) United States Patent
Ueda et al.

(10) Patent No.: US 8,666,281 B2
(45) Date of Patent: Mar. 4, 2014

(54) PROCESS CARTRIDGE AND DEVELOPING DEVICE

(75) Inventors: Kaori Ueda, Yokohama (JP); Hideki Maeshima, Mishima (JP); Shuichi Gofuku, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 189 days.

(21) Appl. No.: 13/285,365

(22) Filed: Oct. 31, 2011

(65) Prior Publication Data

US 2012/0114377 A1 May 10, 2012

(30) Foreign Application Priority Data

Nov. 10, 2010 (JP) ..... 2010-251899
Sep. 28, 2011 (JP) ..... 2011-212963

(51) Int. Cl.
*G03G 15/08* (2006.01)
*G03G 21/18* (2006.01)

(52) U.S. Cl.
USPC ..... 399/119; 399/113

(58) Field of Classification Search
USPC ..... 399/119, 111, 110, 113
See application file for complete search history.

(56) References Cited

U.S. PATENT DOCUMENTS

| | | | | |
|---|---|---|---|---|
| 5,815,782 | A | 9/1998 | Yokomori et al. | |
| 6,839,529 | B2 | 1/2005 | Yasui et al. | |
| 7,024,137 | B2 | 4/2006 | Nittani et al. | |
| 7,215,909 | B2 | 5/2007 | Nittani et al. | |
| 8,155,553 | B2 | 4/2012 | Takarada | |
| 2003/0228173 | A1 | 12/2003 | Nittani et al. | |
| 2005/0095039 | A1 * | 5/2005 | Kayahara et al. | 399/279 |
| 2006/0013618 | A1 | 1/2006 | Nittani et al. | |
| 2009/0297202 | A1 | 12/2009 | Takarada | |
| 2011/0255898 | A1 | 10/2011 | Kashiide et al. | |

FOREIGN PATENT DOCUMENTS

| | | | |
|---|---|---|---|
| CN | 1172975 | A | 2/1998 |
| CN | 101470396 | A | 7/2009 |
| CN | 101592900 | A | 12/2009 |
| JP | 10-171332 | A * | 6/1998 |

OTHER PUBLICATIONS

Notification of the First Office Action dated Dec. 27, 2012, in Chinese Application No. 201110352706.0.

* cited by examiner

*Primary Examiner* — Sophia S Chen
(74) *Attorney, Agent, or Firm* — Fitzpatrick, Cella, Harper & Scinto

(57) ABSTRACT

A developing device detachably mountable to a main assembly of an image forming apparatus includes a developing roller for developing an electrostatic latent image formed on an electrophotographic photosensitive member, with the developing roller including an elastic roller portion and a core metal portion for supporting the roller portion, a developing device frame for rotatably supporting the developing roller, and a developer layer thickness regulating member, contacting the roller portion of the developing roller, for regulating a layer thickness of a developer carried on the developing roller. In addition, a movement preventing portion prevents movement of the developing roller in an axial direction, wherein the movement preventing portion is detachably mounted in the developing device and is inserted into a spacing between an end portion of the core metal portion and an opposing portion of the developing device frame opposing the end portion of the core metal portion with respect to the axial direction of the developing roller. The movement preventing portion is removed from the developing device when the developing roller develops the electrostatic latent image.

10 Claims, 10 Drawing Sheets

PROCESS CARTRIDGE AND DEVELOPING DEVICE

FIELD OF THE INVENTION AND RELATED ART

The present invention relates to a developing device and a process cartridge detachably mountable to an electrophotographic image forming apparatus, and relates to their protective member and regulating member.

Here, an electrophotographic image forming apparatus refers to an apparatus which forms an image on recording material (medium) with the use of an electrophotographic image forming method. As an example of an electrophotographic image forming apparatus, an electrophotographic copying machine, an electrophotographic printer (for example, laser beam printer, LED printer, etc.), a facsimile machine, etc., may be included.

Further, the process cartridge refers to a cartridge in which an electrophotographic photosensitive drum and a charging means, a developing means or a cleaning means are integrally supported, and which is detachably mountable to a main assembly of an image forming apparatus. Further, the process cartridge refers to a cartridge in which the electrophotographic photosensitive drum and at least one of the charging means, the developing means and the cleaning means are integrally supported, and which is detachably mountable to the main assembly of the image forming apparatus. Further, the process cartridge refers to a cartridge in which at least the developing means and the electrophotographic photosensitive drum are integrally supported, and which is detachably mountable to the main assembly of the electrophotographic image forming apparatus.

In an electrophotographic image forming apparatus which uses an electrophotographic image forming process, a process cartridge system, in which the electrophotographic photosensitive drum and one or more processing means acting on the electrophotographic photosensitive drum are integrally supported in a cartridge which is detachably mountable to the main assembly of the electrophotographic image forming apparatus have been conventionally employed. According to this process cartridge system, it is possible for a user to perform maintenance of the apparatus by himself (herself) without relying on a service person, so that operativity can be significantly improved. Therefore, the process cartridge system has been widely used in the electrophotographic image forming apparatus.

In the electrophotographic image forming apparatus, the electrophotographic photosensitive drum is irradiated with light emitted from a laser, an LED, a lamp, or the like, corresponding to image information. As a result, an electrostatic latent image is formed on the electrophotographic photosensitive drum. The electrostatic latent image is developed by a developing device. Then, the developed (electrostatic latent) image on the electrophotographic photosensitive drum is transferred onto the recording material. As a result, an image is formed on the recording material.

In the above-described process, the process cartridge is required, during mounting thereof to the electrophotographic image forming apparatus main assembly, that a portion of the electrophotographic photosensitive drum to be opposed to the recording material and a portion of the electrophotographic photosensitive drum to be opposed to the main assembly-side process means acting on the electrophotographic photosensitive drum are exposed.

Therefore, in order not to damage the surface of the electrophotographic photosensitive drum before the use of the process cartridge and during transportation of the process cartridge, a protective member detachably mountable to the process cartridge is provided to the process cartridge. Then, during the use of the process cartridge, the process cartridge is mounted to the electrophotographic image forming apparatus main assembly in a state in which the protective member is removed.

Further, the process cartridge is provided with a developing roller as a developer carrying member and a developer layer thickness regulating member on a developing device frame. In the conventional constitution, in order to absorb expansion and contraction of the developing device frame or the like due to a fluctuation in environment and to absorb an individual component tolerance, there is a need to provide play with respect to a developing roller axial direction. When the developing roller is driven, thrust force acts on the developing roller by a gear but when the developing roller is not driven, the developing roller is in a movable state in the axial direction relative to a developing container and the developer layer thickness regulating member. Here, it is assumed that vibration occurs in various directions during the transportation of the process cartridge but in the case where the vibration occurs in the developing roller axial direction, the developing roller vibrates in its axial direction in some cases. At this time, sliding occurs between the developing roller and the developer layer thickness regulating member and a history thereof remains on the developing roller, so that there is a possibility that an initial image defect is caused. Therefore, as a positional regulation method of the developing roller with respect to the axial direction, there is an urging means for effecting positioning of the developing roller with respect to the developing roller axial direction (U.S. Pat. No. 7,024,137).

SUMMARY OF THE INVENTION

The present invention provides further development of the above-described conventional constitution.

In the conventional constitution, with respect to the developing roller axial direction, a spring was provided at an end side of the process cartridge to prevent movement of the developing roller in the axial direction. However, there was a problem of an increase in cost due to increases in the number of parts and in the number of assembling steps.

A principal object of the present invention is to provide a developing device and a process cartridge which prevent sliding (friction) between a developing roller and a developer layer thickness regulating member to prevent an occurrence of an image defect by always holding the developing roller at a certain position with respect to the developing roller axial direction with a simple constitution.

According to an aspect of the present invention, there is provided a developing device detachably mountable to a main assembly of an image forming apparatus, comprising:

a developing roller for developing an electrostatic latent image formed on an electrophotographic photosensitive member, the developing roller including an elastic roller portion and a core metal portion for supporting the roller portion;

a developing device frame for rotatably supporting the developing roller;

a developer layer thickness regulating member, contacting the roller portion of the developing roller, for regulating a layer thickness of a developer carried on the developing roller; and a movement preventing portion for preventing movement of the developing roller in an axial direction, wherein the movement preventing portion is detachably mounted in the developing device and is inserted into a spacing between an end portion of the core metal portion and an opposing portion of the developing device frame opposing the end portion of the core metal portion with respect to the axial direction of the developing roller.

According to another aspect of the present invention, there is also provided a process cartridge detachably mountable to a main assembly of an image forming apparatus, comprising:

an electrophotographic photosensitive member;

a developing roller for developing an electrostatic latent image formed on the electrophotographic photosensitive member, the developing roller including an elastic roller portion and a core metal portion for supporting the roller portion;

a developing device frame for rotatably supporting the developing roller;

a developer layer thickness regulating member, contacting the roller portion of the developing roller, for regulating a layer thickness of a developer carried on the developing roller; and a movement preventing portion for preventing movement of the developing roller in an axial direction, wherein the movement preventing portion is detachably mounted in the process cartridge and is inserted into a spacing between an end portion of the core metal portion and an opposing portion of the developing device frame opposing the end portion of the core metal portion with respect to the axial direction of the developing roller.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

[Embodiment 1]

Hereinafter, the process cartridge (hereinafter referred to simply as cartridge) and electrophotographic color image forming apparatus (hereinafter referred to simply as image forming apparatus), in Embodiment 1 of the present invention will be described.

(Structure of Image Forming Apparatus)

Figure 2:
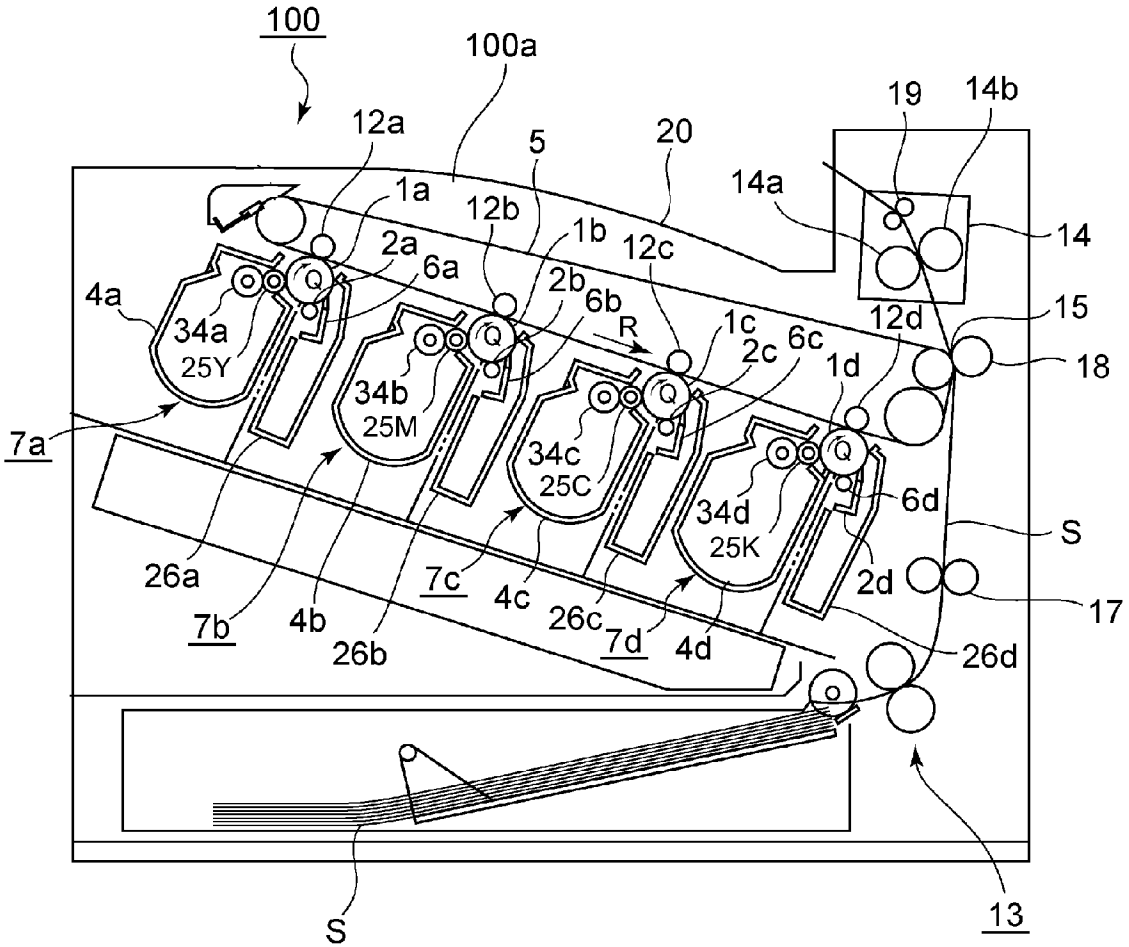
FIG. 2 is a schematic view showing a general structure of a color electrophotographic image forming apparatus in the Embodiment 1.

First, with reference to FIG. 2, the general structure of the image forming apparatus will be described. The image forming apparatus 100 shown in FIG. 2 includes four cartridges 7 (7*a*-7*d*) which are juxtaposed obliquely and are detachably mountable thereto.

Each of the cartridges 7 includes a single electrophotographic photosensitive drum (hereinafter referred to as photosensitive drum) 1 (1*a*-1*d*). The photosensitive drum 1 is rotationally driven, in the clockwise direction indicated by an arrow in the figure, by a driving member (unshown). Around the photosensitive drum 1, electrophotographic process means such as charging rollers 2 (2*a*-2*d*), developing rollers 25 (25Y, 25M, 25C, 25K) and cleaning members 6 (6*a*-6*d*) are disposed. Each charging roller 2 uniformly charges the surface of the photosensitive drum 1. Each developing roller 25 develops an electrostatic latent image with the toner to be visualized. Each cleaning member 6 removes, after a developer image formed on the photosensitive drum 1 is transferred onto a recording material, the toner remaining on the photosensitive drum 1. Incidentally, as described later, the photosensitive drum 1, the charge roller 2, the developing roller 25, and the cleaning member 6 are integrally supported in each of a cartridges 7 (7*a*-7*d*). Each cartridge 7 is detachably mountable to an apparatus main assembly 100*a* of the image forming apparatus 100 by a user.

A toner image formed on each of the photosensitive drums 1 is successively primary-transferred onto an intermediary transfer belt 5 by rotation of each photosensitive drum 1 in the direction indicated by an arrow Q, by rotation of the intermediary transfer belt 5 in the direction indicated by an arrow R, and by application of a positive bias to the primary transfer roller 12 (12*a*-12*d*). Then, the four toner images in a superposed state on the intermediary transfer belt 5 are conveyed to the secondary transfer portion 15.

In synchronism with the above-mentioned image forming operation, a sheet S as the recording material is conveyed by a conveying means consisting of a sheet feeding device 13 and the like.

Then, the sheet S conveyed from the sheet feeding device 13 is conveyed to a secondary transfer portion 15 by a registration roller pair 17. At the secondary transfer portion 15, the positive bias is applied to the secondary transfer roller 18. As a result, the four toner images on the intermediary transfer belt 5 are secondary-transferred onto the conveyed sheet S.

A fixing portion 14 as a fixing means fixes the toner images on the conveyed sheet S by applying heat and pressure to the toner images formed on the sheet S. The sheet S on which the unfixed toner images conveyed from the image forming portions are formed is heated and pressed in a fixing nip between a fixing belt 14*a* and a pressing roller 14*b*. As a result, the unfixed toner images on the sheet S are fixed on the sheet S. Thereafter, the sheet S on which the toner images are fixed is discharged on a (sheet) discharge tray 20 by a discharging roller pair 19.

(Cartridge)

Figure 3:
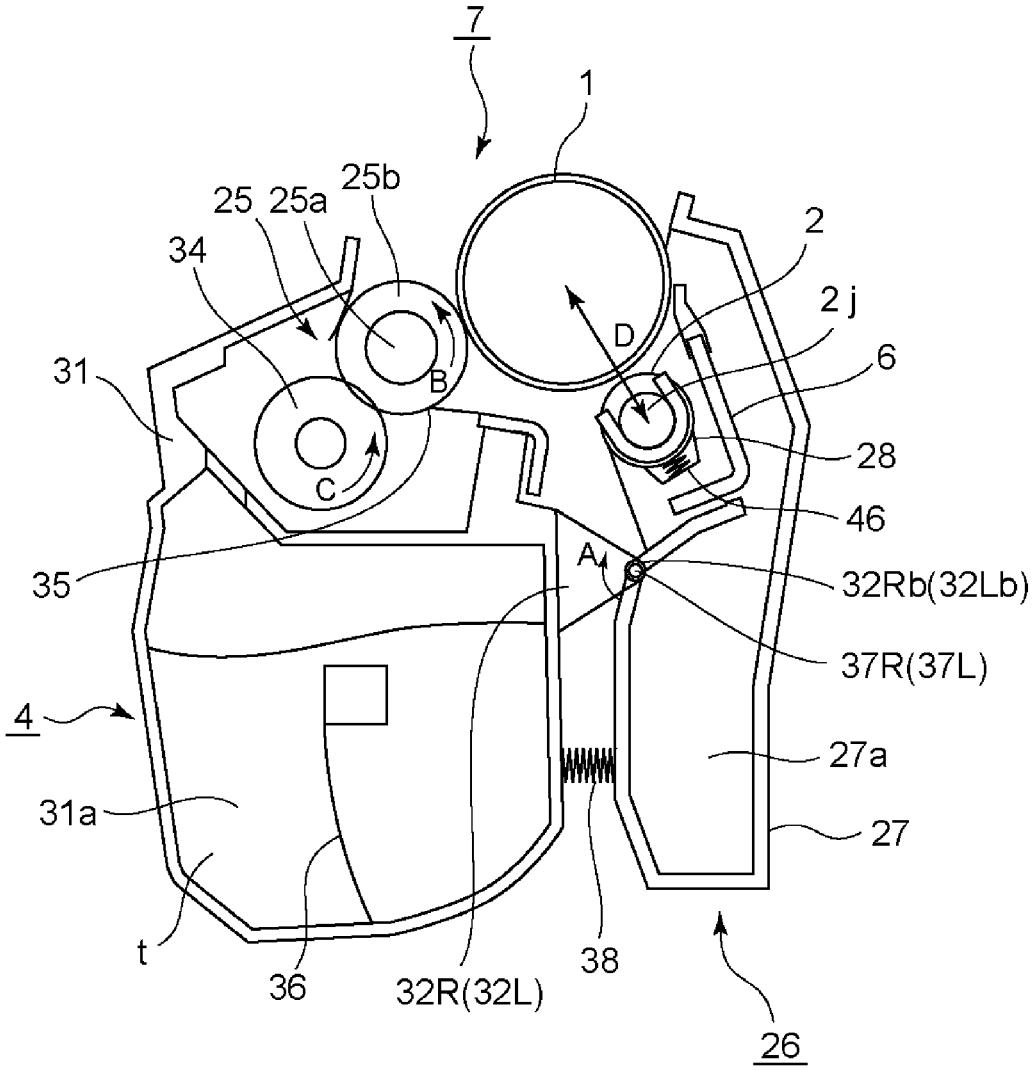
FIG. 3 is a schematic sectional view for illustrating the process cartridge.

Next, the cartridge in this embodiment will be described with reference to FIG. 3. FIG. 3 is a principal sectional view of the cartridge 7 containing toner t. Incidentally, the four cartridges 7 (7*a*-7*d*) are the process cartridges for forming images of yellow, magenta, cyan, and black, respectively. The respective cartridges 7*a*-7*d* are the same in structure except that the colors of the toners accommodated therein are different from each other.

Each cartridge 7 is separated into a photosensitive member unit 26 (26*a*-26*d*) as a first unit and a developing unit 4 (4*a*-4*d*) as a second unit. The photosensitive member unit 26 includes the photosensitive drum 1, the charge roller 2, and the cleaning member 6. The developing unit 4 includes the developing roller 25. The photosensitive drum 1 is rotatably mounted on a cleaning device frame 27 of the photosensitive member unit 26 through bearings 50R and 50L (FIG. 5) described later. The photosensitive drum 1 is rotationally driven correspondingly to the image forming operation by transmitting the driving force from a motor (unshown) to the photosensitive member unit 26.

The charge roller 2 and the cleaning member 6 are disposed on the peripheral surface of the photosensitive drum 1 as described previously. The residual toner removed from the surface of the photosensitive drum 1 by the cleaning member 6 falls into the removed toner chamber 27*a*. The cleaning device frame 27 is fitted with a pair of charging roller bearings 28, which are movable in the direction indicated by an arrow D, which passes through the centers of the charging roller 2 and the photosensitive drum 1. A shaft 2*j* of the charge roller 2 is rotatably supported by the pair of charging roller bearings 28. Further, the bearings 28 are in a state in which they are urged toward the photosensitive drum 1 by a charge roller pressing member 46.

The developing unit 4 has the developing roller 25 rotating in contact with the photosensitive drum 1 in the direction indicated by an arrow B, and has a developing device frame 31. The developing roller 25 is rotatably supported by the developing device frame 31 through shaft supporting member 32 (32R, 32L) attached to both longitudinal sides of the developing device frame 31. The developing roller 25 is constituted by a roller portion 25*b* which is an elastic member and by a core metal portion 25*a* for supporting the roller portion 25*b*. Further, on a peripheral surface of the developing roller 25, a toner supplying roller 34 (34*a*-34*d*) and a developer layer thickness regulating member 35 are disposed. The toner supplying roller 34 contacts the roller portion 25*b* of the developing roller 25 and rotates in the direction indicated by an arrow C to supply the developer to the developing roller 25. The developer layer thickness regulating member 35 contacts the roller portion 25*b* of the developing roller 25 and regulates a layer thickness of the toner carried on the developing roller 25. Further, in a toner containing portion 31*a* of a developing device frame 31, a toner conveying member 36 conveying the contained toner to the toner supplying roller 34 while stirring the toner is provided. The developing unit 4 is rotatably connected to the photosensitive member unit 26 about shafts 37 (37R and 37L) engageable with holes 32Rb and 32Lb provided in the shaft supporting members 32R and 32L. The developing unit 4 is urged by an urging spring 38. Thus, during the image formation using the cartridge 7, the developing unit 4 rotates about the shafts 37 in the direction indicated by an arrow A, so that the developing roller 25 is contacted to the photosensitive drum 1.

Next, movement prevention of the developing roller with respect to the developing roller axial direction will be described in detail with reference to FIGS. 1 and 4 to 10.

Figure 1:
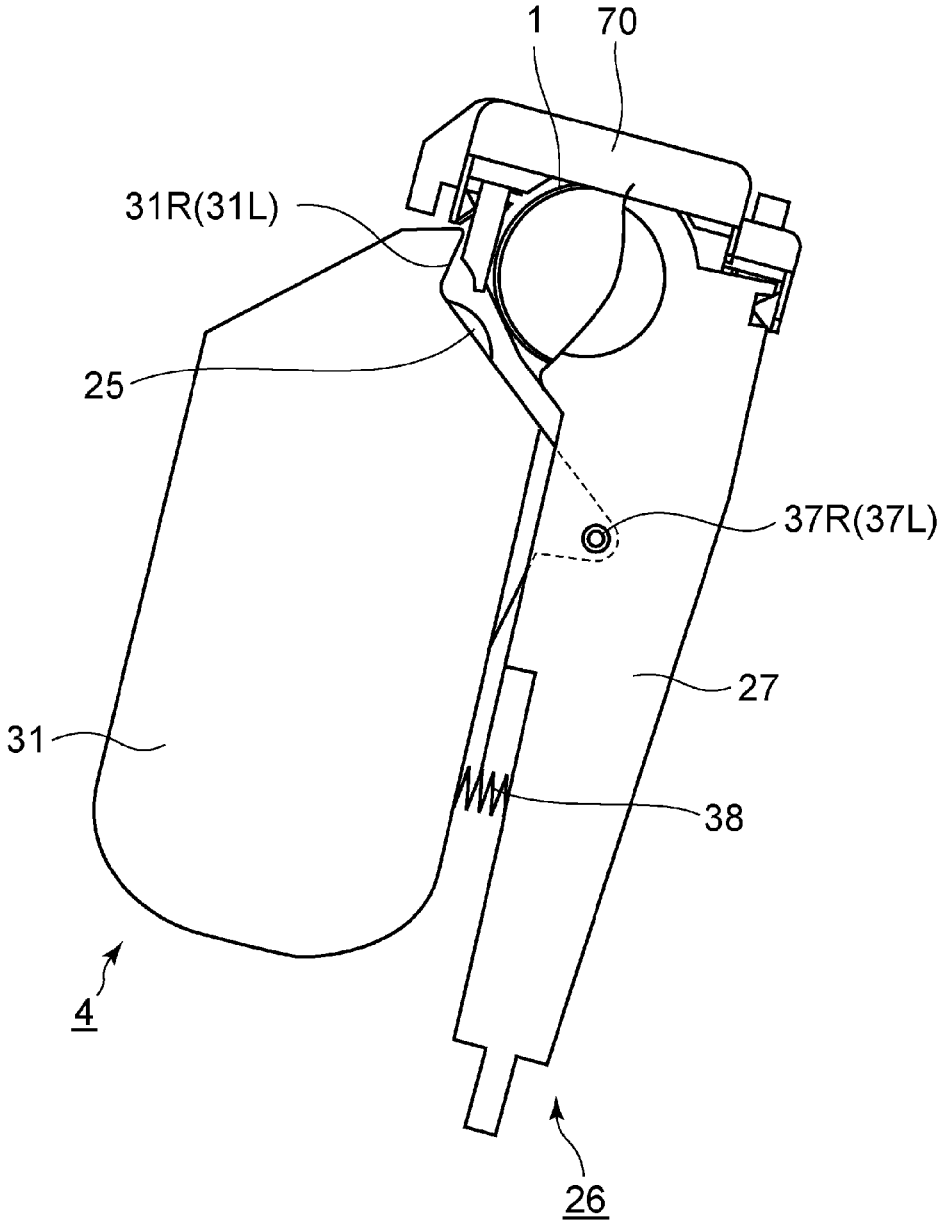
FIG. 1 is a schematic view showing a characterizing portion of a process cartridge in a First Embodiment 1.

As shown in FIG. 1, a protective member 70 is provided so as to protect the photosensitive drum 1 during the non-use of the cartridge 7 and is detachable during the use of the cartridge 7. The protective member 70 is a cover for covering and protecting the photosensitive drum 1 when being mounted on the cartridge 7.

Figure 4:
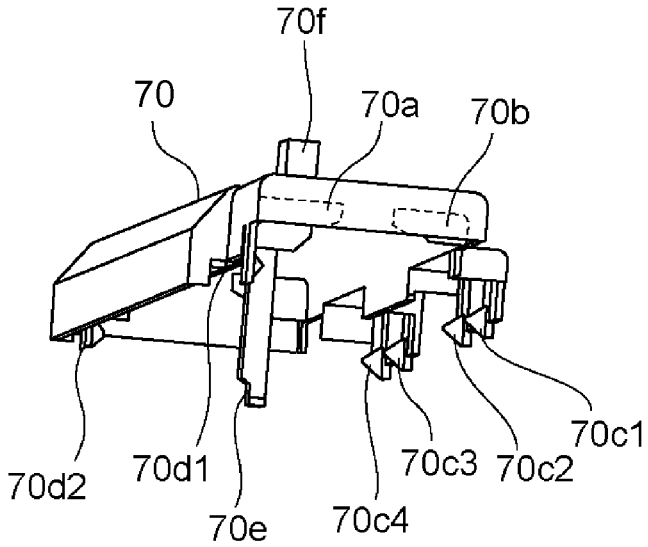
FIG. 4 is a perspective view of a protective member.

Here, the protective member 70 is, as shown in FIG. 4, provided with hooking claw portions 70*c*1-70*c*4, 70*d*1 and 70*d*2, a movement preventing portion 70*e* for regulating the developing roller position, and abutment portions 70*a* and 70*b*.

Figure 5:
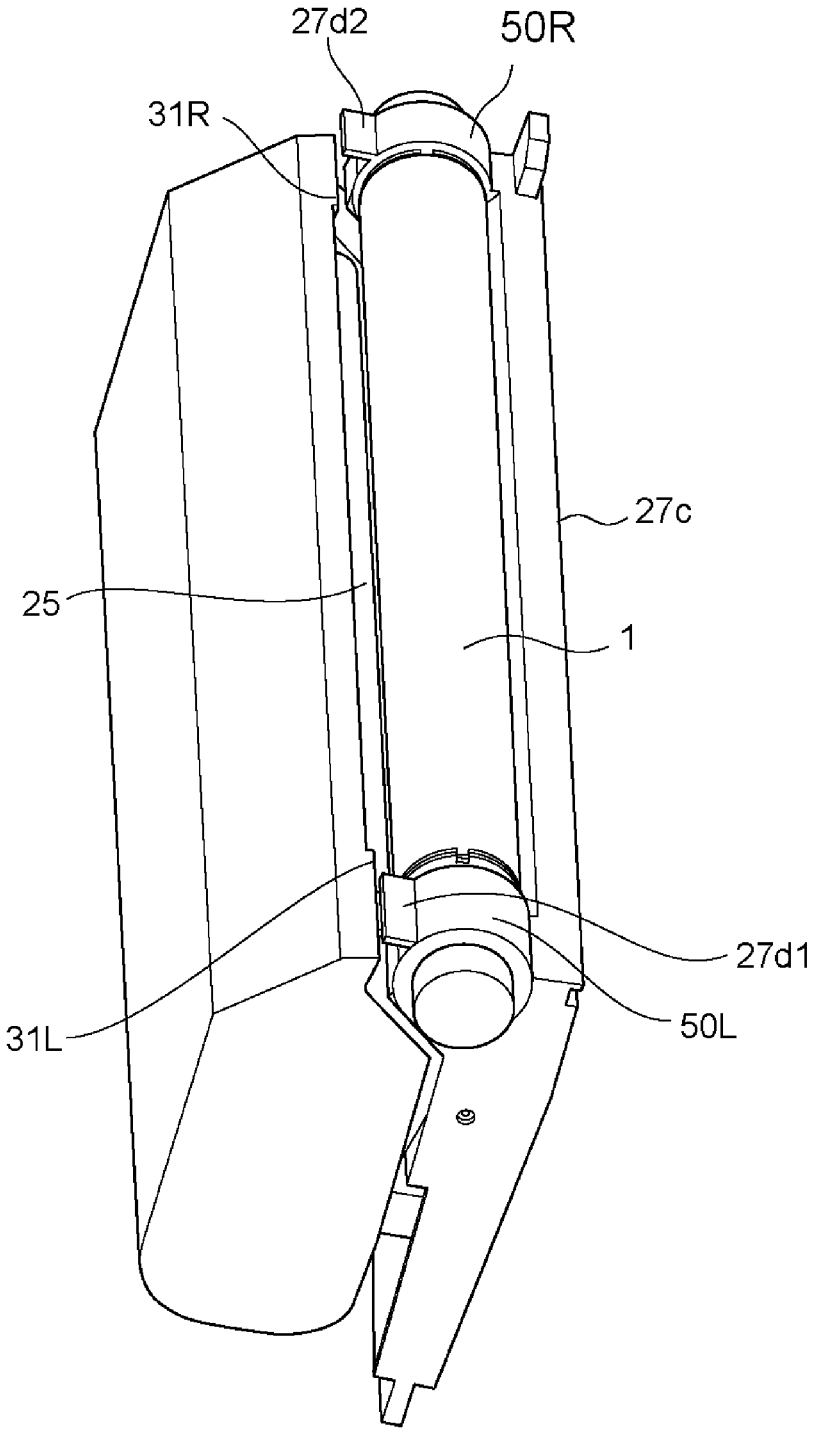
FIG. 5 is a perspective view of the process cartridge.

On the other hand, to the cartridge 7, as shown in FIG. 5, claw hooking portions 27*c*, 27*d*1, and 27*d*2 provided on a cleaning device frame 27 abutment portions 31R and 31L provided on the developing device frame 31, and bearing portions 50R and 50L are provided.

Figure 6:
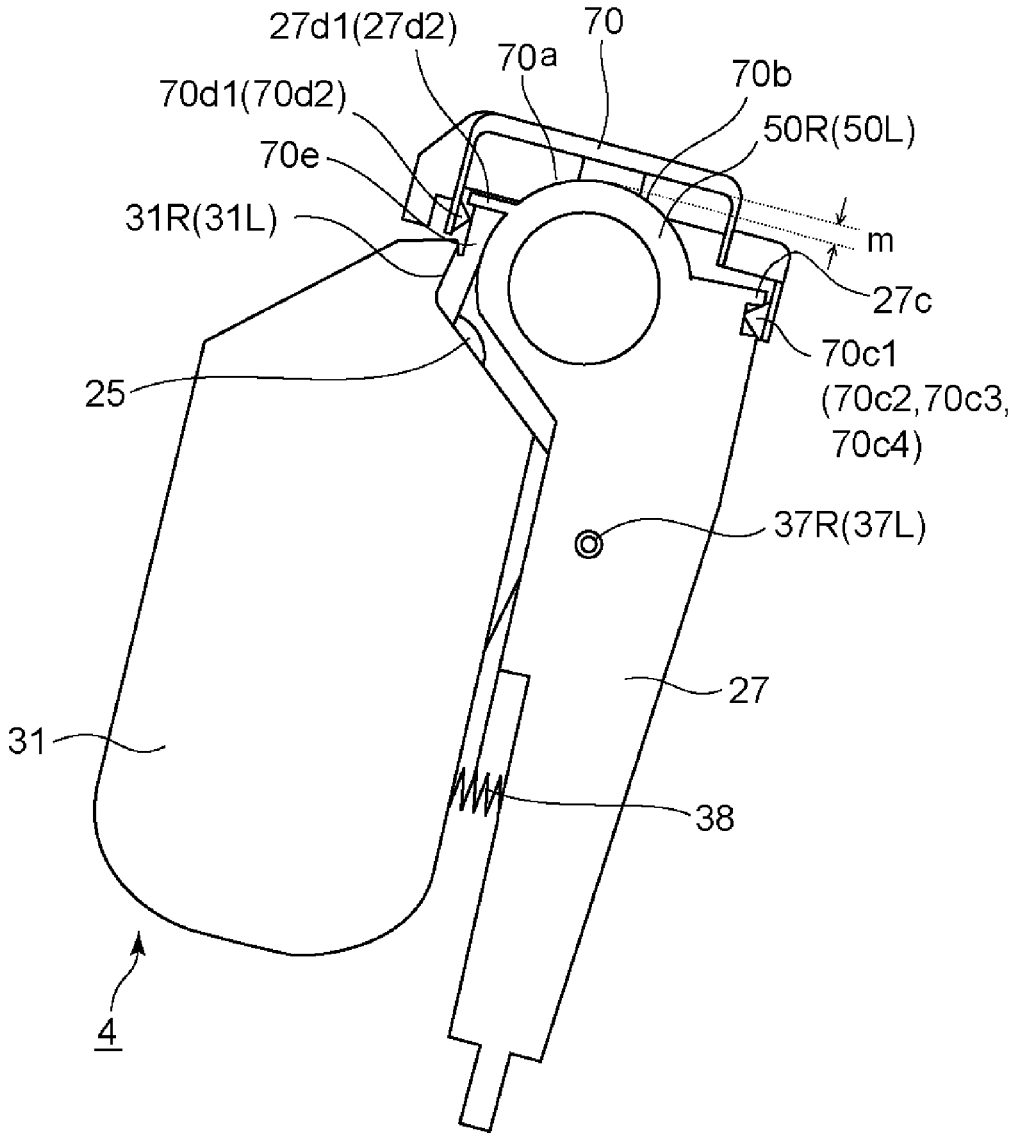
FIG. 6 is a schematic sectional view for illustrating mounting of the protective member to the process cartridge.
Figure 7:
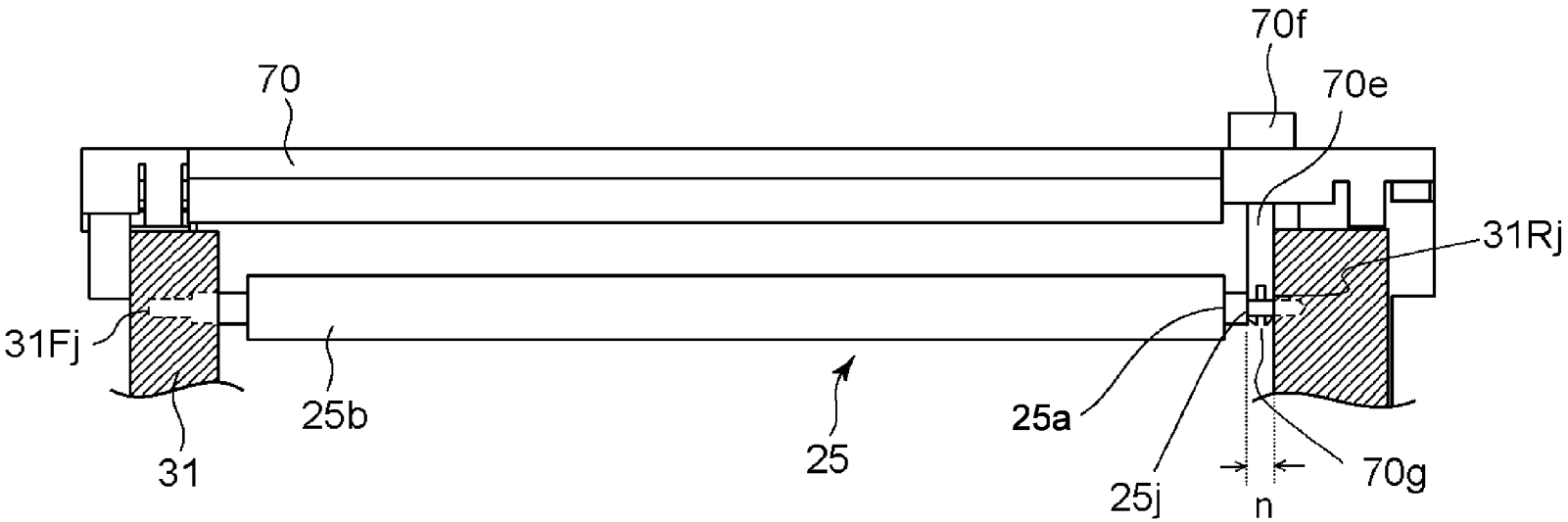
FIGS. 7 to 10 are sectional views for illustrating principal parts in Embodiments 1, 2 and 3, respectively.

The mounted state of the protective member 70 is shown in FIGS. 6 and 7. First, a distance m between the photosensitive drum 1 and the protective member 70 is kept by abutment of the bearing abutment portions 70*a* and 70*b* of the protective member 70 against the drum bearing portion 50R (50L) mounted on the cleaning device frame 27. Therefore, the contact of the protective member 70 with the photosensitive drum 1 is prevented.

Further, the hooking claw portions 70*c*1 to 70*c*4 and the hooking claw portions 70*d*1 and 70*d*2 of the protective member 70 are hooked on the frame hooking portion 27*c* and the hooking portions 27*d*1 and 27*d*2 of the cleaning device frame 27, respectively, so that the protective member 70 is fixed on the cartridge 7.

As shown in FIG. 7, the developing device frame 31 is provided with a contact portion 31Rj at a longitudinal end side of the developing device frame 31. Further, at an end portion of the developing roller core metal portion 25*a* with respect to the developing roller axial direction, a stepped portion is provided by decreasing stepwise a diameter of the core metal portion 25*a*. An end surface of the stepped portion of the core metal portion 25*a* constitutes an abutting portion 25*j*. The contact portion 31Rj of the developing device frame 31 is an opposing portion opposing the abutting portion 25*j*. On the other hand, at the other longitudinal end side of the developing device frame 31, a contact portion 31Fj is provided.

The movement preventing portion is inserted into a spacing (gap) n between the contact portion 31Rj and the abutting portion 25*j*, so that the developing roller 25 is abutted against the contact portion (abutting portion) 31F*j*; and thus movement of the developing roller 25 is prevented.

Here, with respect to the axial direction of the developing roller 25, the end of the movement preventing portion 70*e* has a width larger than the spacing n. However, the movement preventing portion 70*e* is provided with a slit 70*g* at its end side and therefore can enter the spacing n by bending the end thereof in the axial direction of the developing roller 25. Further, by the bending of the end of the movement preventing portion 70*e*, an elastic force is generated. By this elastic force, the movement preventing portion 70*e* urges the abutting portion 25*j*, thus urging the developing roller 25 in the axial direction. The developing roller 25 urged by the movement preventing portion 70*e* is abutted against the abutting portion 31Fj, so that the movement of the developing roller 25 in the axial direction is prevented.

Incidentally, even in the case where the width of the end of the movement preventing portion 70*e* is smaller than the spacing n, when a difference with the spacing n is very small, a similar effect is obtained. Further, in this embodiment, at one end portion of the core metal portion 25*a*, the stepped portion as the abutting portion 25*j* is provided but is not necessarily required to be provided to the core metal portion 25*a*. That is, such a constitution that the movement of the developing roller 25 in the axial direction is prevented by inserting the movement preventing portion 70*e* into the spacing between the end portion of the core metal portion 25*a* and the opposing portion of the developing device frame 31 opposing the end portion may be employed.

In this embodiment, the protective member 70 is provided with the movement preventing portion 70*e* and therefore there is no need to separately provide a preventing member for regulating the position of the developing roller 25 with respect to the axial direction, so that the number of parts can be reduced.

Figure 8:
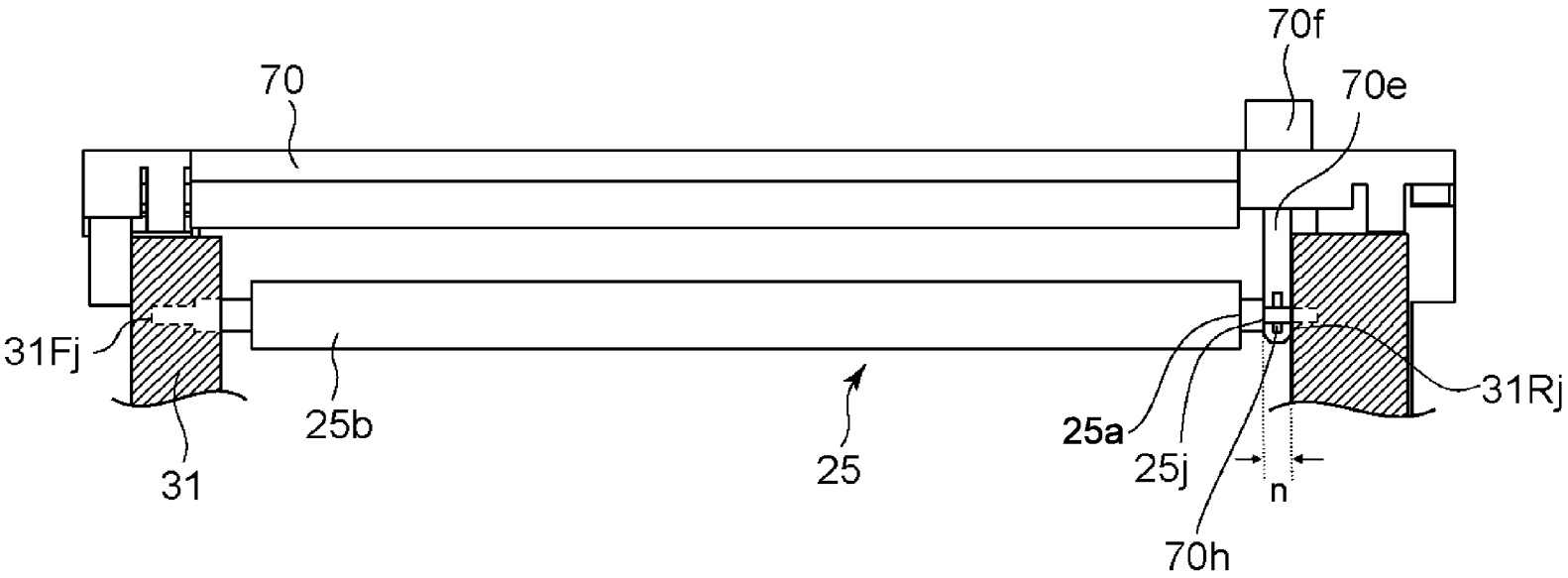

Further, in this embodiment, the movement preventing portion 70*e* is provided with the slit 70*g* at its end side but an effect similar to the above-described effect is obtained even in the case where the movement preventing portion 70*e* is provided with a hollow 70*h* on an axial line of the developing roller 25 as shown in FIG. 8.

The protective member 70 is provided with, at a surface opposite from the surface opposing the photosensitive drum 1, a holding portion 70*f* for being held when the protective member 70 is mounted on and demounted from the cartridge 7. The holding portion 70*f* is provided at a position substantially corresponding to the position of the movement preventing portion 70*e* with respect to the axial direction of the developing roller 25. As a result, a direction of a force acting on the holding portion 70*f* can be made substantially equal to an inserting direction and a demounting direction of the movement preventing portion 70*e* when the protective member is mounted and demounted, respectively. That is, moment such that the movement preventing portion 70*e* is twisted (distorted) is not generated, so that the mounting and demounting of the protective member 70 can be effected without increasing an operating force. In this embodiment, the holding portion 70*f* and the movement preventing portion 70*e* were positioned so as to at least partly overlap with each other as seen from a direction perpendicular to the axial direction of the developing roller 25.

During the use of the cartridge 7, the holding portion 70*f* is raised to remove the protective member 70 and thereafter the cartridge 7 is mounted in the apparatus main assembly 100*a*.

[Embodiment 2]

Next, Embodiment 2 of the present invention will be described with reference to FIG. 9.

Incidentally, the same structural portions or members as those in Embodiment 1 are represented by identical reference numerals or symbols and a portion different from that in Embodiment 1 will be described.

Figure 9:
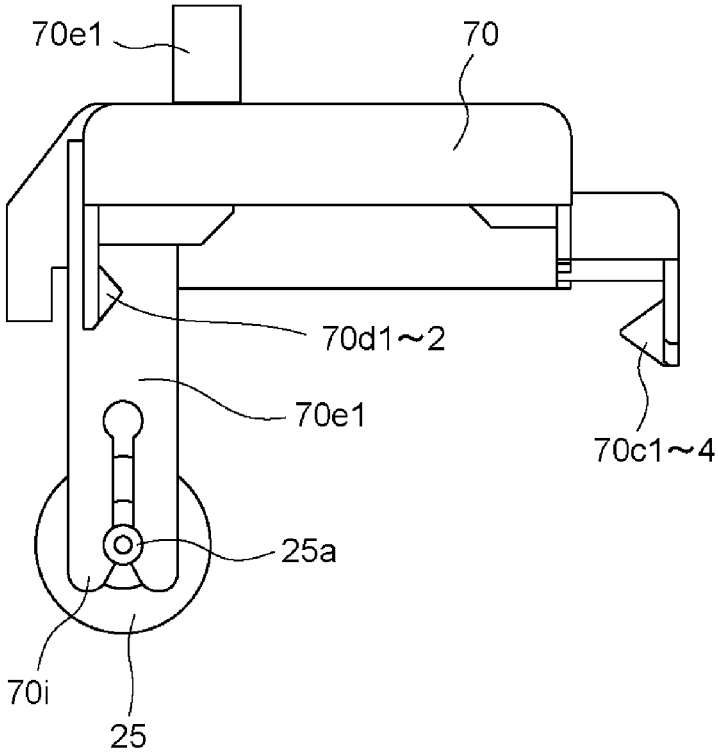

FIG. 9 is a sectional view of a protective member 70 including a movement preventing portion 70*e*1 for effecting movement prevention of the developing roller 25 in the developing roller axial direction in this embodiment. In this embodiment, constitutions of the developing roller 25, the protective member 70, and the contact (abutting) portions 31Rj and 25*j* are the same as those in Embodiment 1.

In this embodiment, as shown in FIG. 9, the movement preventing portion 70*e*1 is provided, as its end, a claw-like engaging portion 70*i* engaged with the core metal portion 25*a* of the developing roller 25. By the engagement of the movement preventing portion 70*e*1 with the core metal portion 25*a*, it is possible to prevent the protective member 70 from being unintentionally demounted from the cartridge 7.

[Embodiment 3]

Next, Embodiment 3 of the present invention will be described with reference to FIG. 10.

Incidentally, the same structural portions or members as those in Embodiment 1 are represented by identical reference numerals or symbols and a portion different from that in Embodiment 1 will be described.

A movement preventing portion 70*e*2 in this embodiment is, different from the movement preventing portion 70*e* in Embodiment 1, not a member provided to the protective member 70 but is characterized in that the movement preventing portion 70*e*2 is mountable to and demountable from the cartridge 7 by itself.

Figure 10:
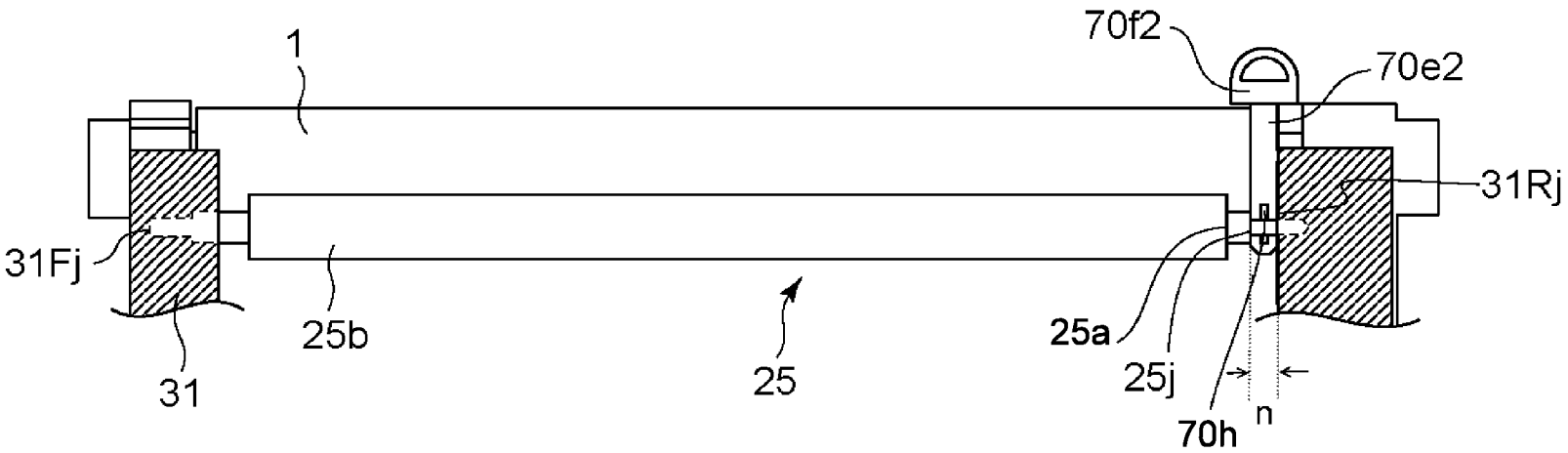

As shown in FIG. 10, at a longitudinal end side of the developing device frame 31, the contact portion 31Rj is provided. Further, at an end portion of the developing roller core metal portion 25*a* with respect to the axial direction, a stepped portion is provided by decreasing stepwise the diameter of the core metal portion 25*a* to constitute the abutting portion 25*j*. The movement preventing portion 70*e*2 is inserted into the spacing n between the contact portion 31Rj and the abutting portion 25*j*, so that the developing roller 25 is abutted against the abutting portion 31Fj provided at the other end side of the developing device frame 31 opposite from the contact portion 31Rj.

Here, the width of the end of the movement preventing member (movement preventing portion) 70*e*2 is larger than the spacing n. Further, the movement preventing member 70*e*2 is provided with a hollow 70*h* on the axial line of the developing roller 25. When the movement preventing member 70*e*2 is inserted, the end of the movement preventing member 70*e*2 is bent in the axial direction of the developing roller 25. As a result, the elastic force is generated to urge the developing roller 25 in the axial direction by the abutting portion 25*j*. Thus, the developing roller 25 is abutted against the abutting portion 31F*j*, so that the axial direction position of the developing roller 25 is regulated. Even in the case where the end width of the movement preventing member 70*e*2 is smaller than the spacing n, when the difference with the spacing n is very small, a similar effect is obtained. Further, in this embodiment, the movement preventing member 70*e*2 is provided with the hollow 70*h* at its inner portion but even in the case where the slit is provided at the end of the movement preventing member 70*e*2, an effect similar to the above-described effect is obtained.

The movement preventing member 70*e*2 is provided with a holding portion 70*f*2. The holding portion 70*f*2 is provided at a position substantially corresponding to the position of the movement preventing member 70*e*2 with respect to the axial direction of the developing roller 25. During the use of the cartridge 7, the holding portion is raised to remove the movement preventing member 70*e*2 and then the cartridge 7 is mounted in the apparatus main assembly 100*a*. The directions of forces acting on the holding portion 70*f*2 when the movement preventing member 70*e*2 is mounted and demounted are the same as those of the insertion and demounting of the movement preventing member 70*e*2, respectively. For that reason, moment such that the movement preventing member 70*e*2 is twisted is not generated and the operating force is not increased, so that the movement preventing member 70*e*2 can be mounted and demounted.

[Other Embodiments]

In the above-described embodiment, the process cartridge including the developing device according to the embodiment of the present invention and the image forming apparatus to which the process cartridge is detachably mountable were described. However, the present invention is not limited thereto but may also be applicable to a developing device mounted in the image forming apparatus, a developing constituted so that only the developing device is detachably mountable, and the like, so that a similar effect can be obtained. In Embodiments 1 and 2, the movement preventing portion 70*e* is provided to the protective member 70 for protecting the photosensitive drum 1 but even when the movement preventing portion 70*e* is provided to a protective member for protecting the developing roller 25, it is possible to obtain a similar effect.

In summary, according to the present invention, with a simple constitution, it is possible to prevent the movement of the developing roller in the axial direction, the sliding (friction) between the developing roller and the developer layer thickness regulating member, and the image defect.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 251899/2010 filed Nov. 10, 2010 and 212963/2011 filed Sep. 28, 2011, which are hereby incorporated by reference.

What is claimed is:

1. A developing device detachably mountable to a main assembly of an image forming apparatus, comprising:

a developing roller for developing an electrostatic latent image formed on an electrophotographic photosensitive member, said developing roller including an elastic roller portion and a core metal portion for supporting said roller portion;

a developing device frame for rotatably supporting said developing roller;

a developer layer thickness regulating member, contacting said roller portion of said developing roller, for regulating a layer thickness of a developer carried on said developing roller; and a movement preventing portion for preventing movement of said developing roller in an axial direction, wherein said movement preventing portion is detachably mounted in said developing device and is inserted into a spacing between an end portion of said core metal portion and an opposing portion of said developing device frame opposing the end portion of said core metal portion with respect to the axial direction of said developing roller, wherein said movement preventing portion is detached from said developing device when said developing roller develops the electrostatic latent image.

2. A developing device according to claim 1, wherein said movement preventing portion has a thickness larger than the spacing with respect to the axial direction and is provided with a slit or a hollow through which said movement preventing portion is insertable into the spacing.

3. A developing device according to claim 1, wherein said movement preventing portion includes an engaging portion engageable with said core metal portion when being inserted into the spacing.

4. A developing device according to claim 1, further comprising a protective member, wherein said movement preventing portion is provided on said protective member for protecting said developing roller.

5. A developing device according to claim 4, wherein said protective member is provided with a holding portion for being held when said developing device is demounted, and wherein said holding portion and said movement preventing portion at least partly overlap with each other when being viewed from a direction perpendicular to the axial direction.

6. A process cartridge detachably mountable to a main assembly of an image forming apparatus, comprising:

an electrophotographic photosensitive member;

a developing roller for developing an electrostatic latent image formed on said electrophotographic photosensitive member, said developing roller including an elastic roller portion and a core metal portion for supporting said roller portion;

a developing device frame for rotatably supporting said developing roller;

a developer layer thickness regulating member, contacting said roller portion of said developing roller, for regulating a layer thickness of a developer carried on said developing roller; and a movement preventing portion for preventing movement of said developing roller in an axial direction, wherein said movement preventing portion is detachably mounted in said process cartridge and is inserted into a spacing between an end portion of said core metal portion and an opposing portion of said developing device frame opposing the end portion of said core metal portion with respect to the axial direction of said developing roller, wherein said movement preventing portion is detached from said process cartridge when said developing roller develops the electrostatic latent image.

7. A process cartridge according to claim 6, wherein said movement preventing portion has a thickness larger than the spacing with respect to the axial direction and is provided with a slit or a hollow through which said movement preventing portion is insertable into the spacing.

8. A process cartridge according to claim 6, wherein said movement preventing portion includes an engaging portion engageable with said core metal portion when being inserted into the spacing.

9. A process cartridge according to claim 6, further comprising a protective member, wherein said movement preventing portion is provided on said protective member for protecting said electrophotographic photosensitive member.

10. A process cartridge according to claim 9, wherein said protective member is provided with a holding portion for being held when said developing device is demounted, and wherein said holding portion and said movement preventing portion at least partly overlap with each other when being viewed from a direction perpendicular to the axial direction.

* * * * *